United States Patent [19]

Drumm

[11] 4,214,339

[45] Jul. 29, 1980

[54] ROTARY BROOM CORE ASSEMBLAGE

[75] Inventor: Arthur E. Drumm, Marysville, Ohio

[73] Assignee: Marysville Rotary Broom Service, Inc., Marysville, Ohio

[21] Appl. No.: 32,171

[22] Filed: Apr. 23, 1979

[51] Int. Cl.[2] ..... A46B 13/02

[52] U.S. Cl. ..... 15/179; 29/117; 242/68.2; 269/48.1; 279/2 R

[58] Field of Search ..... 15/179–183; 279/2; 29/117; 242/68.2; 269/48.1

[56] References Cited

U.S. PATENT DOCUMENTS

| | | | |
|---|---|---|---|
| 2,749,133 | 6/1956 | Rich | 279/2 |
| 3,097,022 | 7/1963 | Sernetz | 15/179 X |
| 3,649,985 | 3/1972 | Hunt | 15/179 |
| 3,900,913 | 8/1975 | Drumm | 15/179 |

*Primary Examiner*—Christopher K. Moore
*Attorney, Agent, or Firm*—Wilson, Fraser, Barker & Clemens

[57] ABSTRACT

The invention provides an improved rotary broom assemblage of the type wherein a plurality of bristles are mounted upon a tubular core element and rotated by a shaft passing through the core element. The invention provides two pairs of circular plates, mounted in spaced relationship on the shaft, with each pair of plates defining an outwardly opening V-shaped groove within which a split ring fastening element is mounted. The tubular core is provided with an annular outwardly projecting depression in its wall portions adjacent each end of the core which are respectively engageable by a split ring member when expanded by axial movement of one of each pair of circular plates toward the other by fastening bolts. Additionally, an axially extending depression in the tubular core element cooperates with key slots in the circular plate members to insure the positive rotation of the core element with the circular plate members, while axial displacement of the core element relative to the shaft is positively prevented by the cooperation of the expanded split ring with the annular depression in the core member.

4 Claims, 2 Drawing Figures

ROTARY BROOM CORE ASSEMBLAGE

BACKGROUND OF THE INVENTION

A large number of rotary broom constructions have heretofore been disclosed and utilized. In my prior U.S. Pat. No. 3,900,913 there is described and claimed a core mounting assemblage for a rotary broom wherein the tubular brush mounting core element of the rotary broom is detachably secured to a drive shaft through the provision of two spaced pairs of circular plates, one of which is rigidly secured to the drive shaft and the other of which is axially movable relative to the drive shaft. The peripheral surfaces of such plates are chamfered to define an outwardly opening circumferential V-shaped groove within which a split ring is mounted. Drawing of the movable plate toward its cooperating fixed plate effects an outward displacement of the split ring into frictional wedging engagement with the interior surface of the core element, thus providing detachable securement of the core element on the drive shaft.

In the commercial utilization of such prior art constructions, it has been observed that the tubular core tends to shift axially with respect to the drive shaft, since it is only frictionally retained against axial movements by the expanded split ring. Such axial displacement results in the edge of the core being damaged by rubbing against laterally adjacent portions of the machine mounting the rotary brush and hence requires that the machine be taken out of service and the core assembly realigned to restore the brush mounting core to its proper axial position.

OBJECTS OF THE INVENTION

It is, accordingly, an object of this invention to provide an improved rotary broom assemblage.

A particular object of this invention is to achieve the mounting of the tubular core element of a roary broom upon a drive shaft through the cooperation of an expandable split ring with an annular depression formed in the walls of the tubular core.

A further object of this invention to eliminate the keys that were previously welded to the interior surface of the tubular core by forming axial depressions in such surface which function as keys.

Other objects and advantages of the invention will be apparent to those skilled in the art from the following detailed description, taken in conjunction with the annexed sheet of drawings.

DESCRIPTION OF PREFERRED EMBODIMENTS

Figure 1:
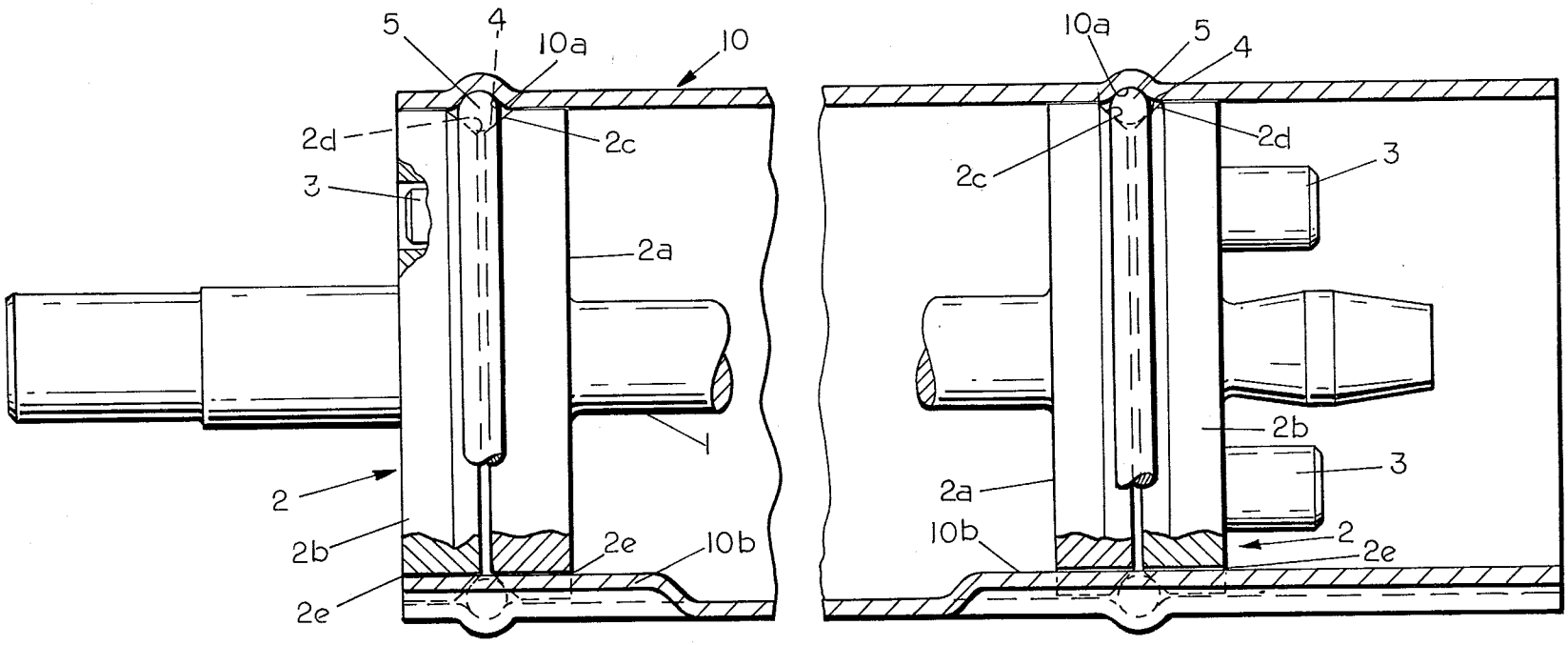
FIG. 1 is a vertical sectional view of an improved rotary broom assemblage embodying this invention.
Figure 2:
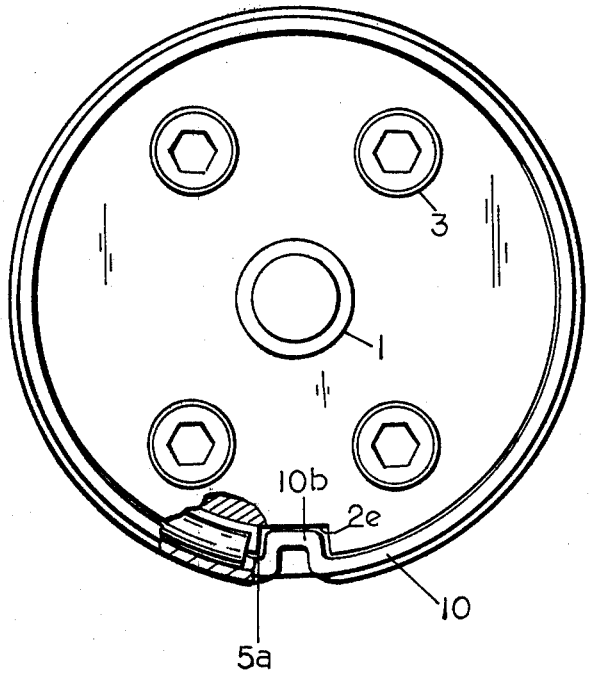
FIG. 2 is a side elevational view, partly in section, of FIG. 1.

Referring to the drawings, the numeral 10 represents a brush mounting core for a rotary broom. As is well known to those skilled in the art, a plurality of bristles (not shown) are generally disposed in channel shaped spiral or circular elements mounted on the exterior surface of the core 10. Since such bristles wear in use, it is desirable that the entire core element 10 be readily removable from its mounting in the machine, and particularly, readily removable from its drive shaft 1, which is normally co-axially disposed within the core 10.

In accordance with this invention, the detachable securement of the tubular core 10 with the drive shaft 1 is effected by the utilization of two spaced pairs of circular plate elements 2. One element **2*a* of each pair is rigidly secured to the drive shaft in any conventional fashion, as for example, by welding. The other circular plate 2*b* of each pair is axially movable relative to the drive shaft 1 and, in particular, is movable to an abutting position with the fixed circular plate 2*a* as shown in FIG. 1 through the tightening of fastening bolts 3**.

The abutting surfaces of each pair of plates 2 are provided with chamfers **2*c* and 2*d* respectively to define an outwardly opening circumferential V-shaped groove 4. A split ring expansion element 5 is mounted in the groove 4 and the normal diameter of ring 5 is such that the periphery of the ring will lie at or below the periphery of the circular plates 2. This diameter is selected so as to permit the combined assemblage of circular plates and split ring to be readily insertable within the interior of the tubular core 10, with each pair of circular plates 2 respectively disposed adjacent the end portions of the core 10**.

In accordance with this invention, that portion of the tubular core 10 which overlies the outwardly opening circumferential V-shaped groove 4 defined by each pair of plates 2 is deformed outwardly to define an annular depression **10*a* into which the split ring 5 may be expanded by tightening of the fastening bolts 3. In this manner, the tubular core 10 is rigidly locked to the plate assemblages 2, hence to the drive shaft 1, against any and all axial displacements. Additionally, the frictional engagement of the split ring 5 with the interior surface of the depression 10*a* assists in the driving of the core 10 for corotation with shaft 1**.

To insure that the tubular core 10 is positively locked to shaft 1 for co-rotation, each of the plates 2 is provided with an axially extending key way slot **2*e* which are in axial alignment. An axially extending depression 10*b* is then formed in each end portion of the core 10 and these depressions extend into the key way slots 2*e* to lock the core 10 to the circular plates 2, and hence to the shaft 1, for co-rotation. The ends 5*a* of split ring 5 lie on either side of axial depression 10*b***.

At any time that it is necessary to replace the core and bristle assembly, it is only necessary to loosen the fastening bolts 3, which permits the movable plate **2*b* to be shifted axially away from its abutting engagement with the fixed plate 2*a* and hence permits the split ring 5 to compress to its normal position wherein it lies entirely within the confines of the internal diameter of the tubular core 10. The ends of the split ring 5 are, of course, disposed on opposite sides of the key slots 2*e* and hence provide no interference with the entry of the axial depression 10*b*** into such key slots.

Modifications of this invention will be apparent to those skilled in the art, and it is intended that the scope of the invention be determined solely by the appended claims.

What is claimed is:

1. A rotary broom assemblage comprising a generally cylindrical core upon the exterior of which a plurality of brush elements are secured in radially projecting relationship, said core having an outwardly directed, annular depression in its wall portion immediately adjacent to one end of the core, a drive shaft adapted to be co-axially inserted within said core, a circular plate secured to said drive shaft for revolution therewith, a second circular plate mounted on said shaft for axial movements relative thereto and being disposed adjacent said first circular plate, fastening means for moving the second plate toward abutting engagement with said first plate, at least one of the abutting surfaces of said circular plates having an inclined circumferential edge surface to define an outwardly opening groove with the abutting plate, said groove underlying said annular depression, a split ring disposed in said groove and extending substantially around said plates, said ring being expansible radially outwardly in response to relative axial displacement of said plates toward each other to expand said ring radially into engagement with the adjacent annular groove in said core, whereby said core is locked against axial displacement relative to said circular plates and is frictionally engaged by said expanded ring to rotate with said drive shaft.

2. The rotary brush assembly defined in claim 1 wherein said circular plates are provided with an axially extending key slot in their periphery, and said core is provided with an axially extending depression in its wall engageable with said key slot, and said split ring is positioned so that the ends thereof are disposed on opposite sides of said axially extending depression.

3. A rotary broom assemblage comprising a generally cylindrical core upon the exterior of which a plurality of brush elements are secured in radially projecting relationship, said core having a pair of outwardly directed, annular depressions in its wall portion respectively adjacent to each end of the core, a drive shaft adapted to be co-axially inserted within said core, a pair of circular plates secured to said drive shaft for revolution therewith, said plates being axially spaced relative to each other so that the periphery of each said plate lies immediately adjacent one of said annular depressions in the core, a second pair of circular plates mounted on said shaft for axial movements relative thereto and being respectively disposed adjacent said first pair of circular plates, fastening means for respectively moving the second pair of plates towards abutting engagement respectively with said first pair of plates, the abutting surfaces of said circular plates each having an inclined circumferential edge surface to define an outwardly opening groove with the abutting plate, a split ring disposed in each said groove formed by said abutting plates and extending substantially around said plates, said ring being expansible radially outwardly in response to relative axial displacement of said plates toward each other to expand said ring radially into engagement with the adjacent annular groove in said core, whereby said core is locked against axial displacement relative to said circular plates and is frictionally engaged by said expanded ring to rotate with said drive shaft.

4. The rotary brush assembly defined in claim 3 wherein said circular plates are provided with an axially extending key slot in their periphery, and said core is provided with an axially extending depression in its wall engageable with said key slot, and said split ring is positioned so that the ends thereof are disposed on opposite sides of said axially extending depression.

* * * * *